United States Patent [19]

Bugler, III et al.

[11] 4,320,073

[45] Mar. 16, 1982

[54] FILM FILL SHEETS FOR WATER COOLING TOWER HAVING INTEGRAL SPACER STRUCTURE

[75] Inventors: Thomas W. Bugler, III, Prairie Village, Kans.; Donald J. Lillig, Grandview, Mo.; Thomas L. Brown, Shawnee Mission; Ohler L. Kinney, Jr., Leawood, both of Kans.

[73] Assignee: The Marley Company, Mission, Kans.

[21] Appl. No.: 206,872

[22] Filed: Nov. 14, 1980

[51] Int. Cl.[3] ..... B01F 3/04

[52] U.S. Cl. ..... 261/112; 261/DIG. 11; 428/183

[58] Field of Search ..... 261/112, DIG. 11, DIG. 72; 428/183

[56] References Cited

U.S. PATENT DOCUMENTS

| | | | |
|---|---|---|---|
| 2,610,835 | 9/1952 | Hytte | 261/112 X |
| 2,793,017 | 5/1957 | Lake | 261/112 |
| 2,917,292 | 12/1959 | Hittrich | 261/112 X |
| 2,977,103 | 3/1961 | Smith et al. | 261/112 X |
| 3,540,702 | 11/1970 | Uyama | 261/112 |
| 3,733,063 | 5/1973 | Loetel et al. | 261/112 |
| 3,739,556 | 6/1973 | Waters | 261/112 X |
| 3,963,810 | 6/1976 | Holmberg et al. | 428/183 X |

FOREIGN PATENT DOCUMENTS

| | | | |
|---|---|---|---|
| 2502303 | 8/1975 | Fed. Rep. of Germany | 261/112 |
| 708310 | 5/1954 | United Kingdom | 261/112 |
| 990851 | 5/1965 | United Kingdom | 261/112 |
| 1182828 | 3/1970 | United Kingdom | 261/112 |

*Primary Examiner*—Richard L. Chiesa

[57] ABSTRACT

An improved, self-positioning, synthetic resin, multiple-sheet fill structure for cooling towers is provided which preferably includes upright, thin fill sheets having elongated, outwardly extending, hollow, cooperable indexing units thereon; the respective indexing units are strategically located and arranged such that opposed units on adjacent sheets are transversely disposed relative to one another and telescopically interengage with two point contact. This construction minimizes sheet warpage while increasing the load and deflection resistance of the fill structure. Preferably, the indexing units are of outwardly tapered configuration and present arcuate, opposed end segments separated by recess-defining walls; inwardly extending bottom walls connected to the recess-defining walls serve as spaced abutment surfaces extending into the hollow regions defined by the units for engaging the associated units on adjacent fill sheets. The indexing units are advantageously arranged in upright columns and horizontal rows on the sheets in such manner that the longitudinal axis of each respective unit is transverse to the longitudinal axes of the next adjacent units in the column and row in which the respective unit belongs.

12 Claims, 10 Drawing Figures

FIG.1
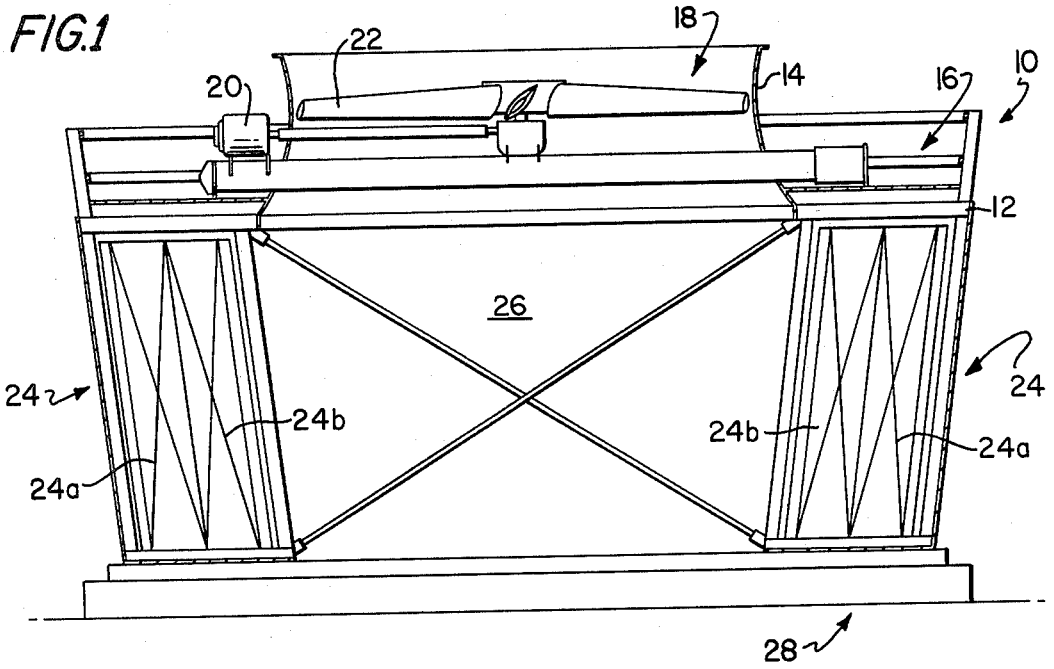
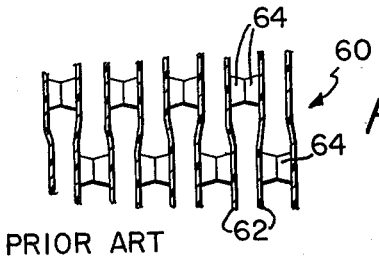
FIG.2
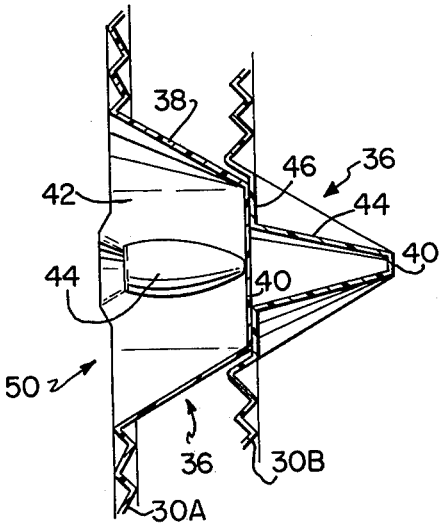
FIG.5
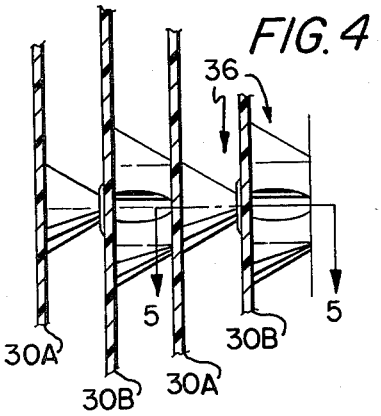
FIG. 4

FIG.3
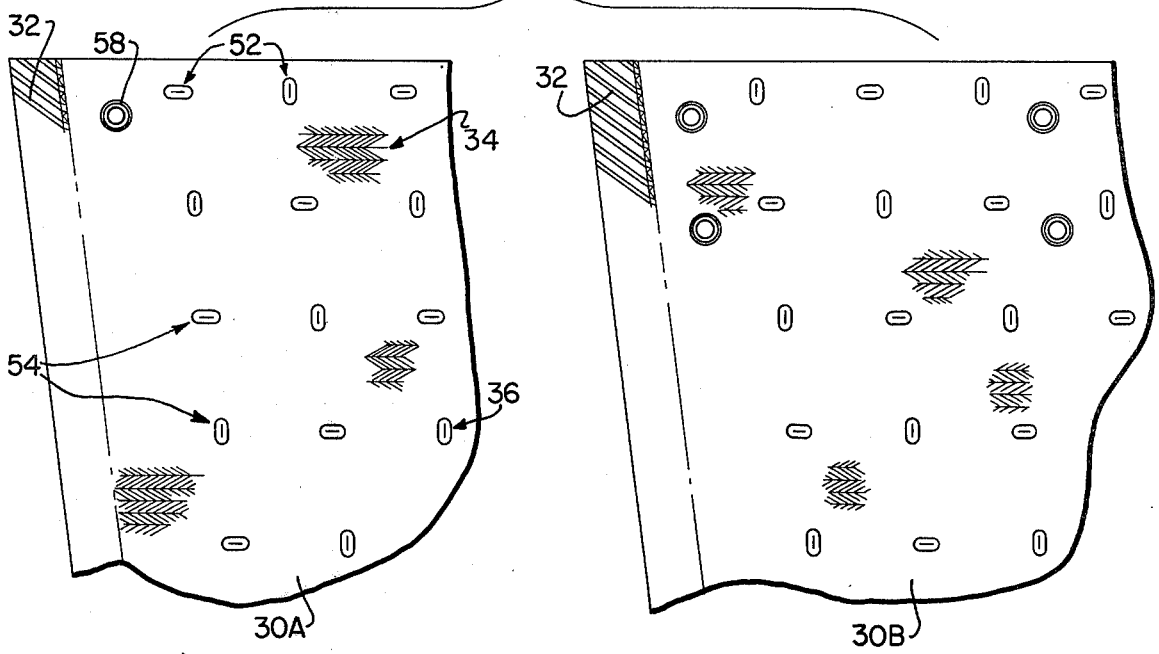
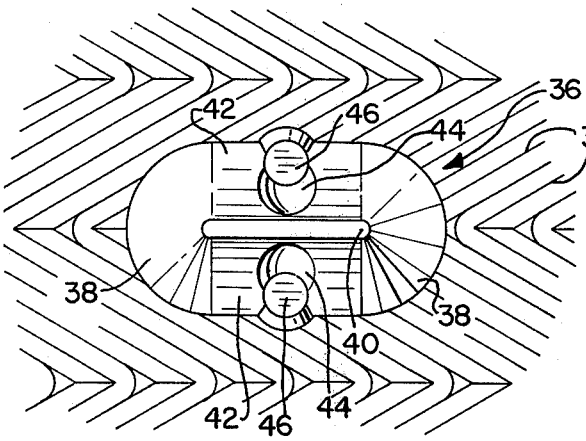
FIG.6
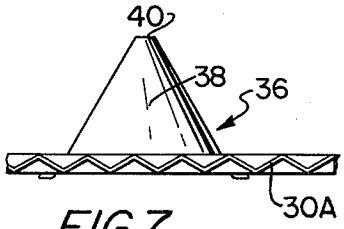
FIG.7
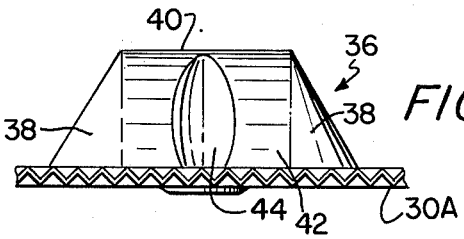
FIG.8

FILM FILL SHEETS FOR WATER COOLING TOWER HAVING INTEGRAL SPACER STRUCTURE

BACKGROUND OF THE INVENTION

1. Field of the Invention

The present invention is concerned with a multiple-sheet fill assembly designed for use in crossflow or counterflow cooling towers in order to effectively disperse a hot fluid to be cooled during passage thereof through the tower. More particularly, it is concerned with such a fill structure wherein the respective sheets include a plurality of spaced, outwardly extending bodies thereon which serve as spacers and indexing units; these bodies are located on the sheets for partial telescopic interfitting with the bodies on adjacent sheets and in such manner that load-induced warpage and deflection of the sheets is minimized.

2. Description of the Prior Art

A wide variety of cooling tower fill structures have been proposed in the past. Generally speaking, the function of these assemblies is to evenly disperse hot water or other fluid as it descends from an overlying basin or the like, in order to maximize thermal interchange between the water and cross or counterflowing air currents passing through the tower.

U.S. Pat. No. 3,733,063 discloses a fill assembly made up of a plurality of upright, chevron-ribbed polyvinyl chloride sheets arranged in spaced, opposed relationship. Each sheet is provided with a plurality of outwardly extending, frustoconical spacer knobs which are designed to engage corresponding plateaus on adjacent fill sheets. The spacer knobs and plateaus on each sheet are arranged in pairs, and are laterally spaced apart.

Multiple-sheet fill structures of the type disclosed in U.S. Pat. No. 3,733,063 are particularly advantageous in that they can be constructed using relatively low cost synthetic resin materials and conventional vacuum forming techniques. This significantly lowers costs and maintenance problems, particularly as compared with prior splash-type fill assemblies employing metallic or wooden components largely constructed on-site.

Despite the many advantages of multiple-sheet synthetic resin fill assemblies, certain problems have been encountered in their use. For example, the non-aligned orientation of spacer knobs between adjacent sheets in the fill assembly tends to create force vectors which lead to warpage and deflection of the sheets, particularly under high water loadings. That is to say, the spacer knobs on adjacent sheets are generally offset both laterally and vertically from one another, and these offsets create torque vectors when a load is imposed on the fill; an accumulation of such vectors can cause the sheets to deflect or twist relative to each other. This can in turn cause undue pressure drops across the fill structure, with the result that cooling efficiency is lowered.

In addition, lack of positive interlock between respective fill sheets can allow the sheets to slide or shift relative to one another. Here again, this is an unwanted effect that can lead to deflection and distortion of the fill assembly, with concomitant efficiency losses.

SUMMARY OF THE INVENTION

In one aspect, the present invention is concerned with a sheet-type fill member which comprises a thin, integral sheet of material (preferably a synthetic resin such as polyvinyl chloride having a thickness of 0.015 to 0.020 inches) which is configured to present a plurality of spaced, outwardly extending, hollow spacers thereon. Each of the spacers includes a pair of spaced, closely adjacent, outwardly extending wall segments which cooperatively define an indexing unit. The units are oriented such that the longitudinal axes of at least certain of the units are disposed transversely relative to the longitudinal axes of others of the indexing units.

Preferably, the indexing units are of outwardly tapered configuration and have arcuate end wall segments and a narrow, elongated top wall joining the same. Moreover, the arcuate end wall segments are separated by a pair of opposed, recess-defining walls. Advantageously, the indexing units are arranged to present spaced, upright columns and spaced, generally horizontally extending rows thereof, with the longitudinal axes of each respective indexing unit being transverse (preferably essentially perpendicular) to the longitudinal axes of the next adjacent units in the column and row in which the respective unit belongs.

A fill assembly in accordance with the invention thus comprises a plurality of spaced, opposed fill sheets each having the described indexing units extending outwardly from one face thereof, and with openings on the other faces of the sheets which communicate with the corresponding hollow regions defined by the indexing units. The units on the separate sheets extend through respective openings on the next adjacent sheet and are at least partially telescoped into corresponding hollow regions. Stable, interlocking, two-point contact between the associated pairs of indexing units is provided by means of abutment surfaces (preferably in the form of bottom walls connected to the recess-defining walls of the units) which extend into the hollow projection regions and engage the associated units of the next adjacent sheet.

In particularly preferred forms, the associated pairs of elongated indexing units are disposed such that their respective longitudinal axes are transverse to one another. Thus, an effective interlock between fill sheets is provided which prevents relative movement between the sheets. At the same time, inasmuch as the spacing and indexing projections on the separate sheets are aligned with one another, virtually no torque forces are created tending to deflect and/or warp the sheets under water loading.

The fill sheets in accordance with the present invention can be made using conventional vacuum forming techniques. Moreover, in the preferred forms, the sheets are formed as two separate packs; one pack has integral inlet louvers along one marginal edge of the sheets, whereas the other pack has marginal, integral drift eliminator structure on the sheets thereof.

BRIEF DESCRIPTION OF THE DRAWINGS

FIG. 1 is an essentially schematic view in partial vertical section of mechanical draft crossflow cooling tower having a fill assembly in accordance with the present invention mounted therein;

FIG. 2 is a fragmentary sectional view illustrating a prior type of multiple-sheet fill structure having offset spacers;

FIG. 3 is a fragmentary view illustrating a pair of louver sheet fill members in accordance with the invention, prior to placement thereof in opposed relationship;

FIG. 4 is a fragmentary side view illustrating the telescopic interfitting of a series of sheet fill members in accordance with the present invention;

FIG. 5 is a sectional view taken along line 5—5 of FIG. 4;

FIG. 6 is an enlarged, fragmentary view depicting a preferred indexing unit on a sheet fill member of the invention;

FIG. 7 is an end view of the indexing unit depicted in FIG. 6.

FIG. 8 is a side view of the projection depicted in FIG. 6.

DESCRIPTION OF THE PREFERRED EMBODIMENT

Figure 9:
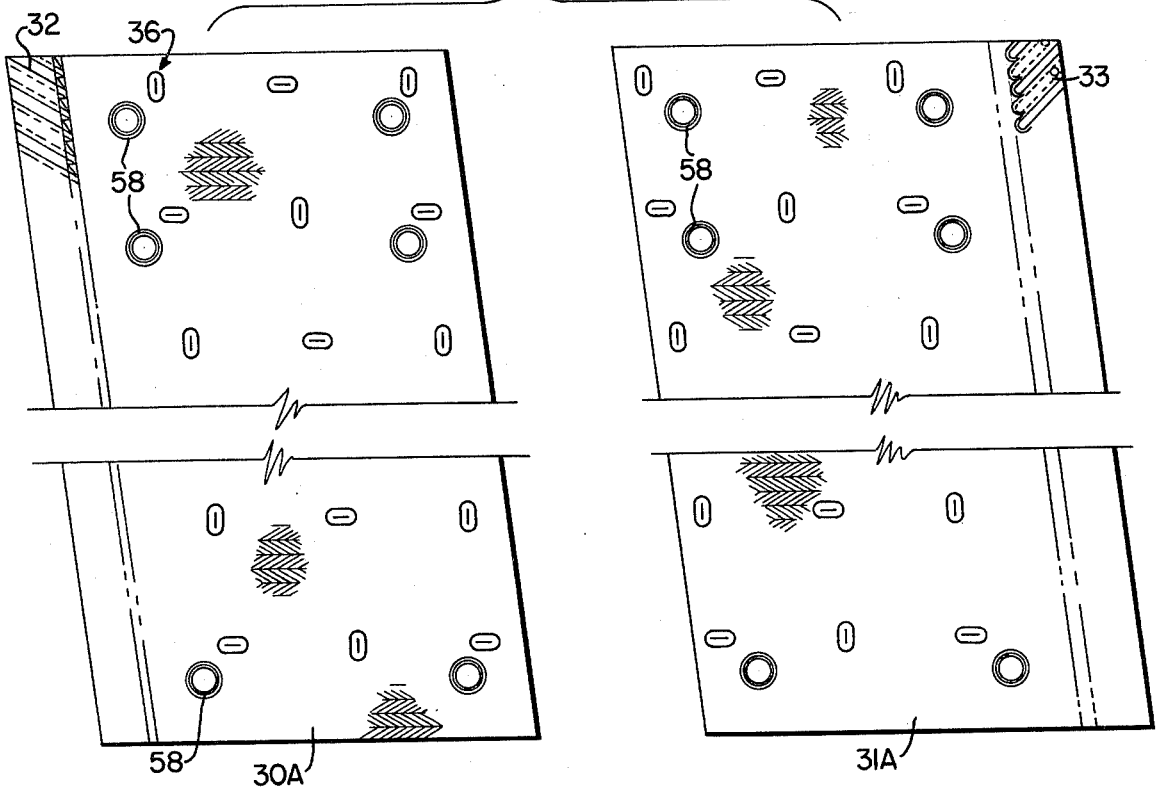
FIG. 9 is an elevational view of a pair of juxtaposed "A" fill sheets, with the lefthand sheet having marginal louvers thereon, and the righthand sheet having marginal drift eliminator structure thereon.

Turning now to the drawings, a cooling tower 10 is schematically illustrated in FIG. 1. The tower is of the crossflow mechanical draft variety, and includes an upper, apertured, horizontally extending deck 12 which supports an upright venturi-shaped fan stack 14 and hot water distribution means 16 in the form of a basin or a series of nozzles. A fan 18 is disposed within stack 14, and is powered by conventional motor 20 and drive 22. The tower 10 further includes, beneath the distribution means 16, schematically illustrated fill structure 24 in the form of separate, multiple sheet packs **24*a* and 24*b*. The inboard face of fill pack 24*b* communicates with a central plenum region 26, which in turn communicates with the interior of stack 14. A cold water collection basin 28 underlies the fill structure 24**, as those skilled in the art will readily understand.

In the operation of tower 10, quantities of initially hot water are delivered to the distribution means 16, whereupon this water flows under the influence of gravity downwardly through the fill structure 24. At the same time, crossflowing currents of air are drawn through the fill structure by means of fan 18, in order that a thermal interchange occurs between the crossflowing air and descending water. The cooled water is ultimately collected in the basin 28 for reuse, and the heated air is discharged to the atmosphere through stack 14.

Fill packs **24*a* and 24*b* are each in the form of a series of spaced, opposed, upright, face-to-face alternate sheet fill members 30A and 30B, and 31A and 31B, respectively. The alternate sheets 30A and 30B define pack 24*a* and have integral, marginal air inlet louvers 32 along the outboard upright edges thereof. The alternate sheets 31A and 31B make up inner pack 24*b*, and the inboard vertical edges of the sheets have molded drift eliminator structure 33 thereon. The respective sheets 30A, 30B, and 31A, 31B are preferably formed of a suitable synthetic resin material such as polyvinyl chloride, and are configured, over the majority of the surface area thereof, to present a series of side-by-side ridges 34** thereon. The ridges are preferably oriented to form a series of chevron patterns on the sheets (see FIG. 3).

In addition, each of the sheets 30A, 30B, and 31A, 31B (which are preferably of integral construction), is configured to present a plurality of spaced, outwardly extending, hollow spacers or indexing units 36 thereon. As best seen in FIGS. 6–8, each of the units 36 includes a pair of spaced, closely adjacent, outwardly extending, arcuate, tapered end wall segments 38 which terminate in and are joined by an elongated, narrow top wall 40. Each unit further includes a pair of converging sidewalls 42 joined to top wall 40 and which include an inwardly extending, arcuate, recess-defining wall 44. Finally, a substantially circular bottom wall 46 is connected to the base of each recess-defining wall 44, and to the main sheet 30.

From the foregoing description, it will be apparent that each outwardly extending unit 36 defines, in the interior thereof, a hollow region 48 (see FIG. 5) and a corresponding opening 50 in communication with the region 48. Moreover, it will be seen that the circular bottom walls 46 extend into the associated regions 48, and this is important for purposes which will be described.

Referring again to FIG. 3, it will be seen that, on each sheet 30A and 30B, the units 36 are oriented such that the longitudinal axes of at least certain of the units are disposed transversely relative to the longitudinal axes of others of the units. More particularly, it will be observed that the units 36 are arranged in upright columns 52 and generally horizontally extending rows 54. Further, the longitudinal axis of each respective unit 36 is transverse (preferably essentially perpendicular) to the longitudinal axes of the next adjacent units in the column and row in which the respective unit 36 belongs. That is to say, for each given column and row, the longitudinal axes of the member units 36 alternate between an upright and a horizontal orientation. This orientation is identical in the sheets 31A and 31B as well.

It will be understood that the sheets 30A, 30B, 31A and 31B are preferably of integral construction and are formed using conventional vacuum forming techniques. Moreover, the louver and drift-eliminator structures are advantageously formed integrally with the sheets 30A, 30B, 31A and 31B, as are mounting aperture cutouts 58 (see FIG. 3). Of course, other forming techniques are possible, and separate louver and/or drift eliminator structure can be provided if desired.

In the construction of a fill assembly pack **24*a* using the sheets 30A and 30B, the sheets are simply supported in an upright, alternate, face-to-face orientation with the elongated projections 36 of each sheet being partially telescoped within associated hollow regions 48 defined by units 36 on the next adjacent sheet 30A or 30B. Alternating "A" and "B" sheets 30A and 30B (described below) are used to form the pack 24*a*. Pipes or other suitable supports are passed through openings in the sheets 30A and 30B cut at the cutouts 58 for supporting and assisting in the alignment of the sheets. Moreover, the longitudinal axes of each associated pair of units 36 on adjacent sheets are transverse (preferably perpendicular) relative to one another. Referring specifically to FIG. 5, it will be seen that the longitudinal axis of the unit 36 on the lefthand sheet 30A is vertically oriented, whereas the longitudinal axis of the unit 36 on the righthand sheet 30B is horizontally oriented. Further, the lefthand unit 36 is partially telescoped within the region 48 of the righthand unit 36. The respective bottom walls 46 of the righthand unit 36 define spaced apart, opposed shoulders or abutment surfaces which engage the top wall 40 of the lefthand projection 36. This limits the extent of telescopic interfitting of the associated units 36**, and moreover provides a stable, two-point contact between the units. It will also be observed that the central axes of the associated units are essentially coincident, thereby eliminating any offset and the warpage and deflection problems associated therewith.

A fill pack 24*b* is formed in the same manner as described in connection with pack 24*a*, except that alternating "A" and "B" sheets 31A and 31B are employed. The packs are thus constructed and mounted within a tower 10 as schematically depicted in FIG. 1.

Figure 10:
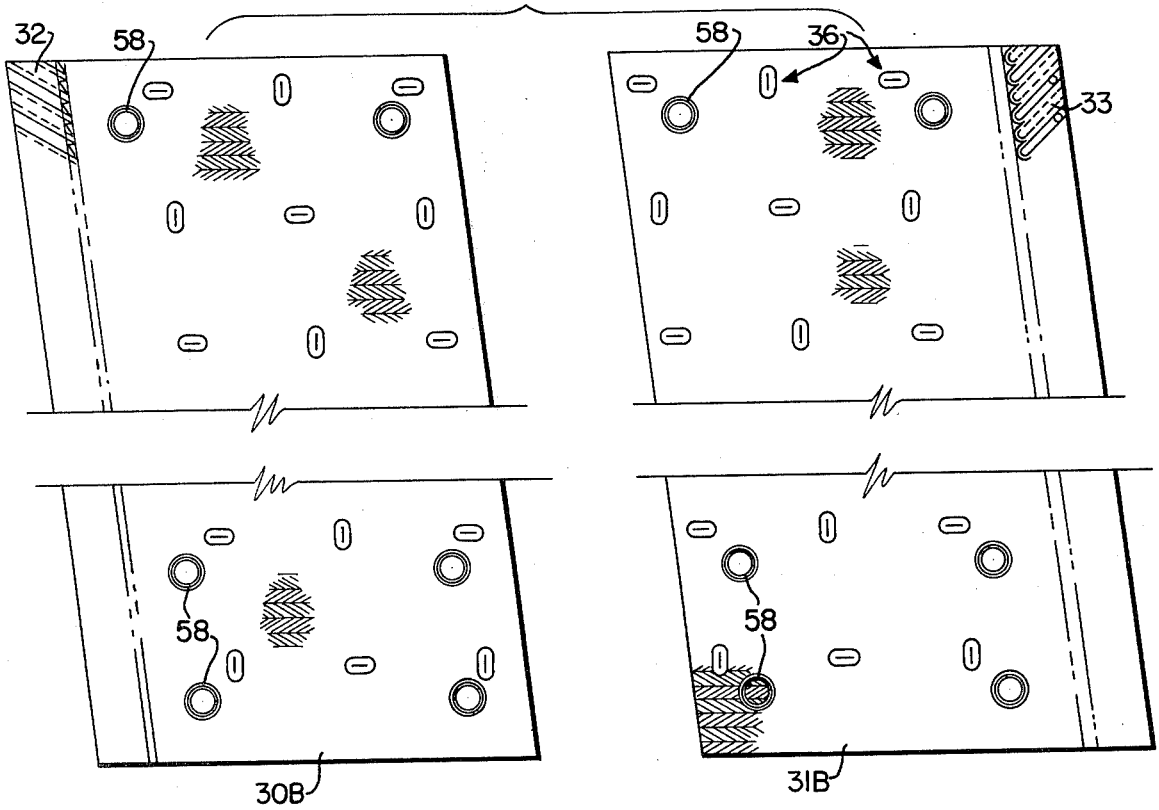
FIG. 10 is an elevational view of a pair of juxtaposed "B" fill sheets, with the lefthand sheet having marginal louvers thereon, and the righthand sheet having marginal drift eliminator structure thereon.

In the construction of the sheets 30A, 30B, 31A and 31B, it has been found advantageous to employ two separate molds, one for the sheets 30A, 30B, and another for sheets 31A, 31B. Referring specifically to FIG. 9, "A" sheets 30A, 31A of the louver and eliminator variety are depicted. In FIG. 10 on the other hand "B" sheets 30B, 31B are illustrated. It will be observed that the "A" and "B" sheets are essentially identical except that: (1) the longitudinal axes of the units 36 on the "A" sheets are perpendicular relative to the associated units 36 on the "B" sheets; and (2) the "A" sheets have four cutouts 58 in the upper portion thereof, and two in the lower portion thereof, whereas this is reversed in the "B" sheets.

In the sheet forming operation, for either sheets 30A, 30B and 31A, 31B, the starting polyvinyl chloride material is fed from a continuous roll into the appropriate vacuum mold. This mold is configured to form six cutouts 58 in each sheet in three equally spaced rows of two cutouts. If "A" sheets are being fabricated, the formed sheets are cut transversely at the lower end thereof so that four cutouts 58 are at the lower end of the sheets, leaving two at the top of the following sheet "A". If "B" sheets are being made, the formed sheets from the mold are cut transversely at the upper end of the sheets so that four cutouts remain at the upper portions of the sheets, and again leaving two cutouts at the bottom. Using this technique, the upper and lower ends of both "A" and "B" sheets are provided with aligned cutouts 58, and the units 36 have the proper relative orientation. At the same time, only a single mold is needed for both "A" and "B" sheets, for a total of two molds for the entire fill assembly 24.

As noted above, a prime advantage of the fill assembly of the present invention is that the spacers/indexing units associated with the sheets 30A, 30B, 31A and 31B are in alignment. This avoids undesirable offsets between spacers in alternate passages in the fill, which can result in sheet warpage and deflection. The present invention is thus distinctly different from typical prior multiple sheet fill assemblies. Referring to FIG. 2, such a typical construction is schematically illustrated. As depicted, the prior fill 60 includes a plurality of spaced, adjacent synthetic resin sheets 62 equipped with integral spacers 64 thereon. The offset relationship between the spacers can create, when the fill 60 is subjected to relatively high temperatures, air pressure, water loadings, and installation biases, warpage between the sheets as illustrated in FIG. 2. Such warpage can take the form of unequal spacing between the sheets 62 as seen in FIG. 2, with the result that cooling efficiency is reduced. The aligned spacers/indexing units of the present invention, however, essentially eliminate this problem.

Having thus described the invention, what is claimed as new and desired to be secured by Letters Patent is:

1. A fill member, comprising:

a thin, integral sheet of material configured to present a plurality of spaced, outwardly extending spacers thereon, said spacers each including a pair of spaced, closely adjacent, outwardly extending wall segments defining a corresponding elongated indexing unit, said units being oriented such that the longitudinal axes of at least certain of the units are disposed transversely of the longitudinal axes of others of said units, said wall segments being in the form of spaced, opposed end walls, there being a pair of opposed recess-defining walls between said end walls and a narrow, elongated top wall joining said end walls, each of said recess-defining walls including inwardly extending, shoulder-defining bottom walls, the bottom walls being spaced apart a distance for engaging the ends of a top wall of another of said units on an adjacent fill member.

2. The fill member as set forth in claim 1, said end walls being of arcuate, tapered configuration.

3. The fill member as set forth in claim 1, said sheet being formed of a synthetic resin material.

4. The fill member as set forth in claim 3, said material being polyvinyl chloride.

5. The fill member as set forth in claim 1, said sheet being configured to present a series of side-by-side ridges thereon between said projections.

6. The fill member as set forth in claim 5, said ridges forming a series of chevron patterns on said sheet.

7. The fill member as set forth in claim 1, said units being arranged to present spaced, upright columns thereof, and spaced, generally horizontal rows thereof, the longitudinal axis of each respective unit being transverse to the longitudinal axes of the next adjacent units in the column and row in which sais respective unit belongs.

8. The fill member as set forth in claim 1, said units extending outwardly from a single face of said sheet.

9. A fill member, comprising:

a thin, integral sheet of material configured to present a plurality of spaced, outwardly extending, elongated indexing units thereon, said units each including a pair of spaced, closely adjacent, outwardly extending wall segments, said wall segments being in the form of opposed end walls, there being a pair of opposed, recess-defining walls between said end walls and an elongated top wall joining said end walls, each of said recess-defining walls including an inwardly extending, shoulder-defining bottom wall, the bottom walls being spaced apart a distance for engaging the ends of a top wall of another of said units on an adjacent fill member.

10. The fill member as set forth in claim 9, said end walls being of arcuate, tapered configuration.

11. The fill member as set forth in claim 9, said sheet being formed of a synthetic resin material.

12. The fill member as set forth in claim 9, said sheet being configured to present a series of side-by-side ridges thereon between said units.

* * * * *